US011391016B2

(12) United States Patent
Kozui et al.

(10) Patent No.: US 11,391,016 B2
(45) Date of Patent: Jul. 19, 2022

(54) CONSTRUCTION MACHINE

(71) Applicants: KOBELCO CONSTRUCTION MACHINERY CO., LTD., Hiroshima (JP); HIROSHIMA UNIVERSITY, Higashi-Hiroshima (JP)

(72) Inventors: Masatoshi Kozui, Hiroshima (JP); Toru Yamamoto, Hiroshima (JP); Kazushige Koiwai, Hiroshima (JP); Masaki Akiyama, Hiroshima (JP)

(73) Assignees: KOBELCO CONSTRUCTION MACHINERY CO., LTD., Hiroshima (JP); HIROSHIMA UNIVERSITY, Hiroshima (JP)

( * ) Notice: Subject to any disclaimer, the term of this patent is extended or adjusted under 35 U.S.C. 154(b) by 0 days.

(21) Appl. No.: 17/270,705

(22) PCT Filed: Aug. 29, 2019

(86) PCT No.: PCT/JP2019/033955

§ 371 (c)(1),
(2) Date: Feb. 23, 2021

(87) PCT Pub. No.: WO2020/045579

PCT Pub. Date: Mar. 5, 2020

(65) Prior Publication Data

US 2021/0332561 A1 Oct. 28, 2021

(30) Foreign Application Priority Data

Aug. 31, 2018 (JP) ..... JP2018-163172

(51) Int. Cl.
*E02F 9/22* (2006.01)

(52) U.S. Cl.
CPC ..... *E02F 9/2228* (2013.01); *E02F 9/2203* (2013.01)

(58) Field of Classification Search
CPC ..... E02F 9/2203; E02F 9/2221; E02F 9/2285; F15B 9/09
See application file for complete search history.

(56) References Cited

U.S. PATENT DOCUMENTS 5,048,296 A 9/1991 Sunamura et al.
9,868,623 B1 1/2018 Guy
(Continued)

FOREIGN PATENT DOCUMENTS

EP 0 378 129 A1 7/1990
JP 64-48103 A 2/1989
(Continued)

OTHER PUBLICATIONS

International Search Report dated Nov. 26, 2019 in PCT/JP2019/033955 filed on Aug. 29, 2019, citing documents AA-AC and AN-AT therein, 2 pages.
(Continued)

*Primary Examiner* — Kenneth Bomberg
*Assistant Examiner* — Matthew Wiblin
(74) *Attorney, Agent, or Firm* — Oblon, McClelland, Maier & Neustadt, L.L.P.

(57) ABSTRACT

A construction machine includes: a flow rate regulating part which regulates a flow rate of hydraulic oil supplied from a hydraulic pump to a hydraulic actuator, and a control device—which controls driving of a work device. The control device includes: an acquiring part for acquiring a motion state amount of a combined center of gravity of a plurality of members which constitute the work device; and a generating part which generates an instruction value for controlling an operation of the flow rate regulating part such that the motion state amount follows a predetermined first target value, the instruction value being used for executing a feedback control based on the first target value and the
(Continued)

motion state amount, and inputs the instruction value to the flow rate regulating part.

5 Claims, 9 Drawing Sheets

(56) References Cited

U.S. PATENT DOCUMENTS

| | | | | |
|---|---|---|---|---|
| 2004/0060205 | A1* | 4/2004 | Yoshino | G05D 16/2026 37/348 |
| 2010/0121496 | A1* | 5/2010 | Paulus | F15B 9/09 700/282 |
| 2013/0066527 | A1 | 3/2013 | Mizuochi et al. | |
| 2013/0213026 | A1* | 8/2013 | Yamamoto | F04B 49/002 60/327 |
| 2013/0332036 | A1* | 12/2013 | Yamamoto | E02F 9/2228 701/50 |
| 2014/0121840 | A1 | 5/2014 | Mizuochi et al. | |
| 2017/0292243 | A1* | 10/2017 | Okada | E02F 3/32 |
| 2019/0106861 | A1* | 4/2019 | Izumi | E02F 3/425 |
| 2019/0218749 | A1 | 7/2019 | Hiromatsu et al. | |

FOREIGN PATENT DOCUMENTS

| | | | |
|---|---|---|---|
| JP | 2-190532 | A | 7/1990 |
| JP | 9-100548 | A | 4/1997 |
| JP | 10-317417 | A | 12/1998 |
| JP | 11-208538 | A | 8/1999 |
| JP | 11-293706 | A | 10/1999 |
| JP | 2018-3516 | A | 1/2018 |
| JP | 2018-135681 | A | 8/2018 |
| WO | WO 2011/148946 | A1 | 12/2011 |
| WO | WO 2012/169531 | A1 | 12/2012 |

OTHER PUBLICATIONS

Extended European Search Report dated Nov. 17, 2021 in European Patent Application No. 19855625.0, citing documents AA, AO and AP therein, 5 pages.

* cited by examiner

CONSTRUCTION MACHINE

TECHNICAL FIELD

The present invention relates to a construction machine such as a hydraulic excavator, for example.

BACKGROUND ART

Recently, in the construction industry, an amount of investment on construction has been decreasing. Further, a percentage of young people engaging in such construction industry has been remarkably decreasing. As a result, aging of people engaging in such construction industry has been underway. On the other hand, in such a social environment, there has been observed a move to enhance productivity by creating an attractive construction site while realizing a construction site which ensures workers to acquire high salary, to have enough holidays and to have a hope in their future. Although the enhancement of productivity and the realization of an attractive construction site are basically values which contradict with each other, there has been a demand for a construction site which satisfies both values. In various industries including, not to mention, construction industry, i-Construction has been in progress under an initiative of the nation. The i-Construction aims at the realization of both the enhancement of productivity and the creation of an attractive construction site. In the i-Construction, productivity per person is enhanced by saving man power with the use of information and communication technology (ICT) construction machines or with the introduction of automation of works.

However, in a construction site, there are still many cases where works require manipulations and determinations performed by human such as a case where the content of a work is not steady or a case where an environment of a construction site is not steady. In such cases, productivity of a construction machine such as a hydraulic excavator is largely influenced by a skill of a manipulator of the construction machine. That is, the manipulator needs to manipulate a plurality of respective manipulation levers of the construction machine in conformity with the environment of a construction site or the content of the work. Accordingly, a skilled manipulator with high skill can realize highly productive and efficient work.

In addition, recently, the number of experienced manipulators has decreased because of aging of the manipulators, and young manipulators are becoming the main players. To ensure high productivity in such circumstances, it is a prerequisite to enhance a manipulation skill of an individual unskilled manipulator. However, since it takes time to enhance a manipulation skill of the unskilled manipulator, it is necessary to take various measures for increasing productivity such as a control of a construction machine.

Conventionally, for example, there has been proposed a technique for providing a highly stable work machine which performs work by taking into account an influence of a sudden stop of a travelling body, a stewing body and a work front (Patent Literature 1). Further, there has been also proposed a technique for providing a work machine where work efficiency can be enhanced while ensuring control accuracy of a machine control by suppressing a change in speed of a hydraulic actuator caused by regeneration of pressurized oil during execution of a machine control (Patent Literature 2).

Specifically, in the work machine of Patent Literature 1, when a manipulation lever is instantaneously returned to a neutral position from a manipulating state, a change in stability until a movable part is completely stopped is predicted with respect to respective movable parts of the work machine, and restrictions on operations necessary for stabilization of the working machine at any times until the respective movable parts are completely stopped are calculated. Then, instruction information supplied to actuators which drive the movable parts is corrected based on a result of the calculation.

That is, the technique disclosed in Patent Literature 1 is a technique which stabilizes the work machine by controlling driving of an actuator by taking into account an influence exerted when the movable part is suddenly stopped. Accordingly, the enhancement of the work efficiency cannot be expected with such a technique.

The technique disclosed in Patent Literature 2 is a technique relating to a machine control which is an assist function used in a finishing work where a distal end of a bucket is moved along a preset design surface (target excavation surface) at a construction site. Accordingly, the enhancement in work efficiency cannot be expected in various kinds of work other than the finishing work in the work machine of Patent Literature 2. Further, the technique of Patent Literature 2 aims at the suppression of a change in speed of a hydraulic actuator caused by the regeneration of pressurized oil. However, in the work machine of Patent Literature 2, it is difficult to completely prevent occurrence of a change in speed of the hydraulic actuator due to the regeneration of pressurized oil in the hydraulic actuator, which a manipulator has not intended. Accordingly, when an unskilled manipulator having a low manipulation skill performs work at a construction site, positional accuracy of an attachment is lowered due to a change in speed of a hydraulic actuator as described above. Accordingly, there is a concern that work efficiency is rather lowered.

CITATION LIST

Patent Literature

Patent Literature 1: WO 2012/169531
Patent Literature 2: JP 2018-003516 A

SUMMARY OF INVENTION

It is an object of the present invention to provide a construction machine capable of enhancing work efficiency even when an unskilled manipulator having low manipulation skill of the construction machine performs various kinds of work at a construction site.

There is provided a construction machine which includes: a lower travelling body; an upper slewing body which is attached to the lower travelling body with a structure which allows the upper slewing body to slew with respect to the lower travelling body; a work device which is attached to the upper slewing body with a structure which allows the work device to swing in a vertical direction with respect to the upper slewing body and includes a plurality of members; a hydraulic pump which discharges hydraulic oil; a hydraulic actuator which drives the work device by receiving a supply of the hydraulic oil discharged from the hydraulic pump; a flow rate regulating part which regulates a flow rate of the hydraulic oil supplied from the hydraulic pump to the hydraulic actuator; and a control device which controls driving of the work device, wherein the control device includes: an acquiring part which acquires a motion state amount of a combined center of gravity of the plurality of members; and a generating part which generates an instruction value for controlling an operation of the flow rate regulating part such that the motion state amount follows a predetermined first target value, the instruction value being used for executing a feedback control based on the first target value and the motion state amount, and inputs the instruction value to the flow rate regulating part.

DESCRIPTION OF EMBODIMENTS

Hereinafter, a construction machine according to an embodiment of the present invention is described with reference to drawings. The embodiment described hereinafter is an example which embodies the present invention, and is not intended to limit the technical scope of the present invention.

Figure 1:
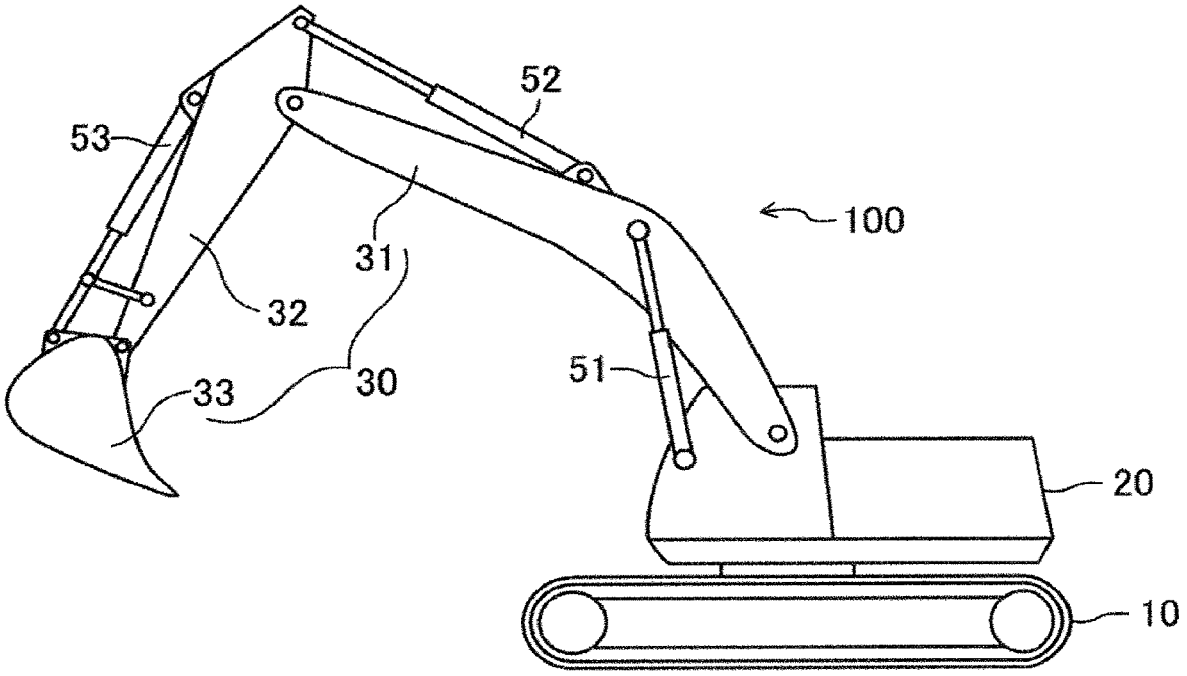
FIG. 1 is a side view showing an example of a construction machine according to an embodiment.

FIG. 1 is a side view showing an example of a construction machine according to the embodiment. A construction machine 100 according to the embodiment shown in FIG. 1 is a hydraulic excavator. The construction machine 100 includes a lower travelling body 10, an upper slewing body 20 mounted on the lower travelling body 10 with a structure which allows the upper slewing body 20 to slew with respect to the lower travelling body 10, and a work device 30 mounted on the upper slewing body 20 with a structure which allows the work device 30 to swing in a vertical direction with respect to the upper slewing body 20. The work device 30 includes a plurality of members which rotate in a vertical direction respectively. The plurality of members include a boom 31, an arm 32, and a bucket 33. The plurality of members are connected to each other. A proximal end of the boom 31 of the work device 30 is supported on a front portion of the upper stewing body 20.

Specifically, the boom 31 has: a proximal end portion supported on a front end of the upper slewing body 20 such that the boom 31 can be raised or lowered, that is, the boom 31 is rotatable in a vertical direction about a horizontal axis; and a distal end portion on a side opposite to the proximal end portion. The arm 32 has: a proximal end portion connected to the distal end portion of the boom 31 in a rotatable manner about a horizontal axis; and a distal end portion on a side opposite to the proximal end portion. The bucket 33 is rotatably attached to the distal end portion of the arm 32.

Figure 2:
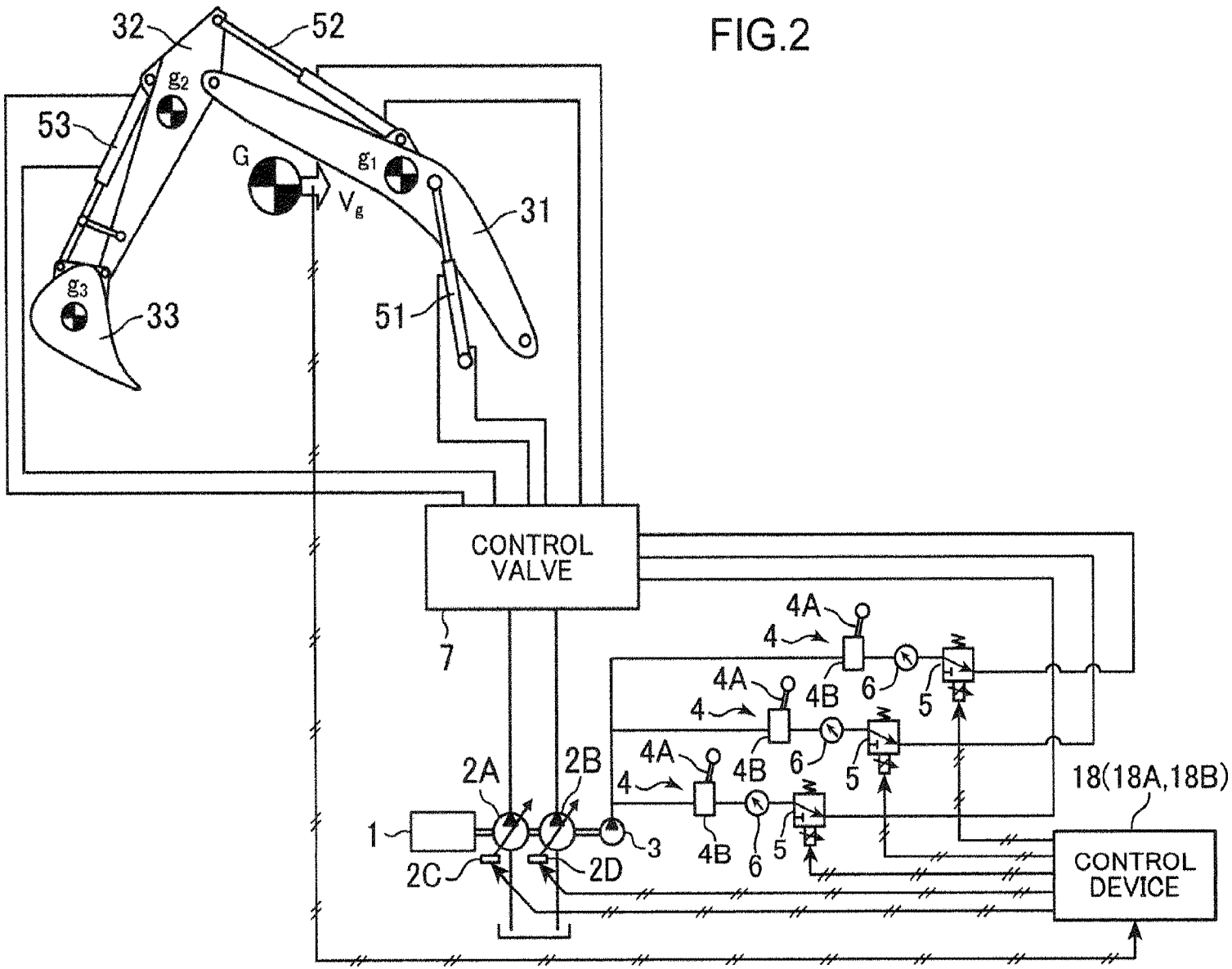
FIG. 2 is a block diagram showing a schematic configuration of a hydraulic system of the construction machine according to the embodiment.

FIG. 2 is a block diagram showing a schematic configuration of a hydraulic system of the construction machine according to the present embodiment. In FIG. 2, constitutional components identical with the corresponding constitutional components of the construction machine shown in FIG. 1 are given the same symbols. As shown in FIG. 2, the construction machine further includes a first hydraulic pump 2A, a second hydraulic pump 2B, a first regulator 2C, a second regulator 2D, a pilot pump 3, a plurality of hydraulic actuators, a plurality of manipulation devices 4, a plurality of pilot pressure control valves 5, a plurality of pressure sensors 6, a control valve 7, and a control device 18. In the present embodiment, the plurality of pilot pressure control valves 5 and the control valve 7 constitute a flow rate regulating part.

The first hydraulic pump 2A, the second hydraulic pump 2B, and the pilot pump 3 are driven by a drive source I such as an engine, and hydraulic oil in a tank is discharged through these pumps.

Each of the first hydraulic pump 2A and the second hydraulic pump 2B is a variable displacement hydraulic pump capable of adjusting a pump capacity.

The first regulator 2C receives inputting of a capacity instruction signal from the control device 18 and regulates a pump capacity of the first hydraulic pump 2A to a capacity corresponding to the capacity instruction signal. In the same manner, the second regulator 2D receives inputting of a capacity instruction signal from the control device 18 and regulates a pump capacity of the second hydraulic pump 2B to a capacity corresponding to the capacity instruction signal.

The pilot pump 3 discharges hydraulic oil (pilot pressurized oil) for opening and closing the control valve 7.

The plurality of hydraulic actuators drive the work device 30 by receiving the supply of hydraulic oil discharged from at least one of the first and second hydraulic pumps 2A and 2B. The plurality of hydraulic actuators include a boom cylinder 51, an arm cylinder 52, and a bucket cylinder 53. The boom 31, the arm 32 and the bucket 33 are respectively driven by a boom cylinder 51, an arm cylinder 52 and a bucket cylinder 53. Specifically, the boom cylinder 51 operates so as to raise and lower the boom 31 by receiving the supply of hydraulic oil discharged from the first hydraulic pump 2A, for example. The aim cylinder 52 operates so as to rotate the arm 32 by receiving the supply of hydraulic oil discharged from the second hydraulic pump 2B, for example. The bucket cylinder 53 operates so as to rotate the bucket 33 by receiving the supply of hydraulic oil discharged from the first hydraulic pump 2A, for example.

The control valve 7 includes a boom control valve, an arm control valve, and a bucket control valve. The boom control valve, the arm control valve, and the bucket control valve each have a pair of pilot ports. When a pilot pressurized oil is supplied to one of the pair of pilot ports of the boom control valve from the pilot pump 3, in accordance with a pilot pressure of the pilot pressurized oil, the boom control valve performs an open/close operation so as to change a direction and a flow rate of hydraulic oil supplied from the first hydraulic pump 2A to the boom cylinder 51. When a pilot pressurized oil is supplied to one of the pair of pilot ports of the arm control valve from the pilot pump 3, in accordance with a pilot pressure of the pilot pressurized oil, the arm control valve performs an open/close operation so as to change a direction and a flow rate of hydraulic oil supplied from the second hydraulic pump 2B to the arm cylinder 52. When a pilot pressurized oil is supplied to one of the pair of pilot ports of the bucket control valve from the pilot pump 3, in accordance with a pilot pressure of the pilot pressurized oil, the bucket control valve performs an open/close operation so as to change a direction and a flow rate of hydraulic oil supplied from the first hydraulic pump 2A to the bucket cylinder 53.

The plurality of manipulation devices 4 include a boom manipulation device 4, an arm manipulation device 4, and a bucket manipulation device 4. In the present embodiment, each of the plurality of manipulation devices 4 is formed of the hydraulic pilot type manipulation device. Each of the plurality of manipulation devices 4 has a manipulation lever 4A and a remote control valve 4B.

The manipulation lever 4A of the boom manipulation device 4 is given a manipulation (boom manipulation) for raising and lowering the boom 31, the manipulation lever 4A of the arm manipulation device 4 is given a manipulation (arm manipulation) for rotating the arm 32, and the manipulation lever 4A of the bucket manipulation device 4 is given a manipulation (bucket manipulation) for rotating the bucket 33.

The remote control valve 4B of the boom manipulation device 4 is a pilot valve interposed between the pilot pump 3 and the pair of pilot ports of the boom control valve in the control valve 7. The remote control valve 4B of the arm manipulation device 4 is a pilot valve interposed between the pilot pump 3 and the pair of pilot ports of the arm control valve in the control valve 7. The remote control valve 4B of the bucket manipulation device 4 is a pilot valve interposed between the pilot pump 3 and the pair of pilot ports of the bucket control valve in the control valve 7.

In each remote control valves 4B, when a manipulation (the boom manipulation, the arm manipulation, or the bucket manipulation) is not applied to the manipulation lever 4A so that the manipulation lever 4A takes a neutral position, the remote control valve 4B is closed, whereby the communication between the pilot pump 3 and the pair of pilot ports is shut off. On the other hand, when the manipulation is applied to the manipulation lever 4A, each remote control valve 4B opens so as to allow a pilot pressure corresponding to a manipulation amount of the manipulation to be inputted to one of the pair of pilot ports of the corresponding control valve from the pilot pump 3.

Accordingly, the boom cylinder 51, the arm cylinder 52, and the bucket cylinder 53 respectively operate in accordance with manipulations by a manipulator applied to the manipulation levers 4A of the plurality of manipulation devices 4 mounted in a cab on the upper slewing body 20. With such manipulations, the boom cylinder 51, the arm cylinder 52, and the bucket cylinder 53 respectively extend and contract so that the boom 31, the arm 32, and the bucket 33 are rotated respectively, whereby the position and the posture of the bucket 33 are changed.

The plurality of pilot pressure control valves 5 and the control valve 7 constitute a flow rate regulating part. The flow rate regulating part regulates the flow rates of the hydraulic oil supplied from the hydraulic pumps 2A and 2B to the plurality of hydraulic actuators 51, 52 and 53 respectively.

Each of the plurality of pilot pressure control valves 5 is formed of a solenoid valve which has a solenoid and, when an instruction value described later outputted from the control device 18 is inputted to the solenoid, the solenoid valve can output a pilot pressure corresponding to the instruction value. The solenoid valve may be, for example, formed of a proportional valve or may be formed of an inverse proportional valve.

Figure 5:
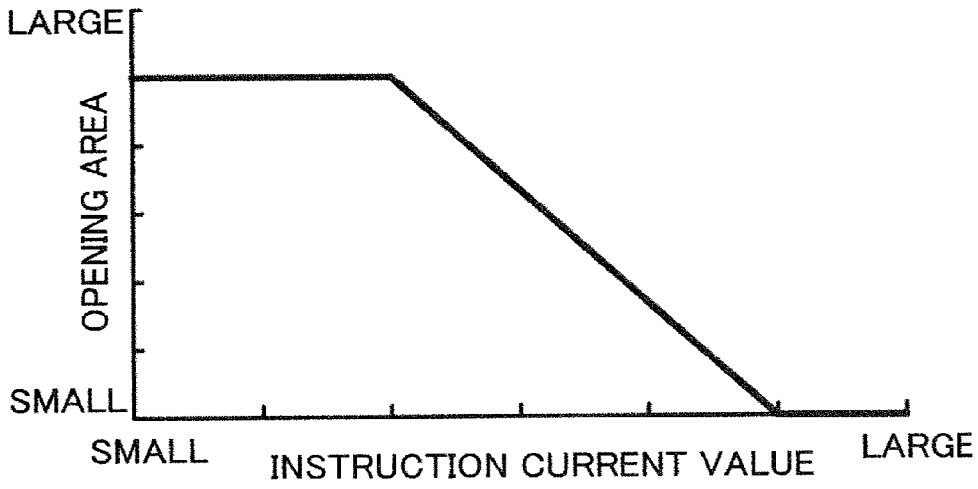
FIG. 5 is a view showing the relationship between an instruction current value with respect to a solenoid valve and an opening area in the construction machine according to the embodiment.

In the present embodiment, each of the plurality of pilot pressure control valves 5 is formed of a solenoid inverse proportional valve having a characteristic shown in FIG. 5, for example. Accordingly, when the instruction value (instruction current value) inputted from the control device 18 to the pilot pressure control valve 5 is zero or smaller than a predetermined value, an opening area of the pilot pressure control valve 5 is maintained at a maximum value. On the other hand, when the instruction value (instruction current value) is equal to or more than the predetermined value, the larger the instruction value is, the smaller the opening area becomes.

The plurality of pilot pressure control valves 5 include a pair of boom pilot pressure control valves 5, a pair of arm pilot pressure control valves 5, and a pair of bucket pilot pressure control valves 5. In FIG. 2, only one of the pair of boom pilot pressure control valves 5, one of the pair of arm pilot pressure control valves 5, and one of the pair of bucket pilot pressure control valves 5 are shown, and the illustration of the other of the pilot pressure control valves 5 is omitted.

The boom pilot pressure control valves 5 are provided for controlling pilot pressures inputted to the pair of pilot ports of the boom control valve in the control valve 7, respectively. The boom pilot pressure control valves 5 are interposed between the remote control valve 4B of the boom manipulation device 4 and the pair of pilot ports of the boom control valve in the control valve 7. When the boom manipulation is applied to the manipulation lever 4A of the boom manipulation device 4, a pilot pressurized oil having a pilot pressure corresponding to a manipulation amount of the boom manipulation is outputted from the remote control valve 4B. The boom pilot pressure control valve 5 can reduce a pilot pressure of the pilot pressurized oil to a pilot pressure corresponding to the instruction value from the control device 18.

The arm pilot pressure control valves 5 are provided for controlling pilot pressures inputted to the pair of pilot ports of the arm control valve in the control valve 7, respectively. The arm pilot pressure control valves 5 are interposed between the remote control valve 4B of the arm manipulation device 4 and the pair of pilot ports of the arm control valve in the control valve 7. When the arm manipulation is applied to the manipulation lever 4A of the arm manipulation device 4, a pilot pressurized oil having a pilot pressure corresponding to a manipulation amount of the arm manipulation is outputted from the remote control valve 4B. The arm pilot pressure control valve 5 can reduce the pilot pressure of the pilot pressurized oil to a pilot pressure corresponding to the instruction value from the control device 18.

The bucket pilot pressure control valves 5 are provided for controlling pilot pressures inputted to the pair of pilot ports of the bucket control valve in the control valve 7, respectively. The bucket pilot pressure control valves 5 are interposed between the remote control valve 4B of the bucket manipulation device 4 and the pair of pilot ports of the bucket control valve in the control valve 7. When the bucket manipulation is applied to the manipulation lever 4A of the bucket manipulation device 4, a pilot pressurized oil having a pilot pressure corresponding to a manipulation amount of the bucket manipulation is outputted from the remote control valve 4B. The bucket pilot pressure control valve 5 can reduce the pilot pressure of the pilot pressurized oil to a pilot pressure corresponding to the instruction value from the control device 18.

The plurality of pressure sensors 6 include a boom pressure sensor 6, an arm pressure sensor 6, and a bucket pressure sensor 6. The boom pressure sensor 6 can detect a pressure of a pilot pressurized oil in an oil passage between the remote control valve 4B of the boom manipulation device 4 and the boom pilot pressure control valve 5. That is, the boom pressure sensor 6 detects a pilot pressure of the pilot pressurized oil outputted from the remote control valve 4B of the boom manipulation device 4. The arm pressure sensor 6 can detect a pressure of a pilot pressurized oil in an oil passage between the remote control valve 4B of the arm manipulation device 4 and the arm pilot pressure control valve 5. That is, the arm pressure sensor 6 detects a pilot pressure of the pilot pressurized oil outputted from the remote control valve 4B of the arm manipulation device 4. The bucket pressure sensor 6 can detect a pressure of a pilot pressurized oil in an oil passage between the remote control valve 4B of the bucket manipulation device 4 and the bucket pilot pressure control valve 5. That is, the bucket pressure sensor 6 detects a pilot pressure of the pilot pressurized oil outputted from the remote control valve 4B of the bucket manipulation device 4. Pressure signals corresponding to pressures (pilot pressures) detected by the plurality of pressure sensors 6 respectively are inputted to the control device 18.

The control device 18 controls driving of the work device 30. As shown in FIG. 2, the control device 18 includes an acquiring part 18A and a generating part 18B. The acquiring part 18A acquires a motion state amount of a combined center of gravity G of the plurality of members 31, 32, 33. The generating part 18B generates an instruction value for controlling an operation of at least one pilot pressure control valve 5 out of the plurality of pilot pressure control valves 5 such that the motion state amount follows a predetermined first target value. The instruction value is an instruction value for executing a feedback control based on a difference between the first target value and the motion state amount. The generating part 18B inputs the generated instruction value to at least one pilot pressure control valve 5 out of the plurality of pilot pressure control valves 5.

In FIG. 2, g1 indicates the center of gravity of the boom 31, g2 indicates the center of gravity of the arm 32, g3 indicates the center of gravity of the bucket 33, and G indicates the combined center of gravity of the work device 30. A method of calculating the combined center of gravity G is described later.

In the present embodiment, the control device 18 acquires a motion state amount of the combined center of gravity G of the plurality of members (the boom 31, the arm 32, and the bucket 33 in the present embodiment) which constitute the work device 30. Then, the control device 18 generates an instruction value for controlling an operation of the pilot pressure control valve 5 of the flow rate regulating part such that the motion state amount follows the predetermined first target value using a feedback control based on the first target value and the motion state amount. Then, the control device 18 inputs the instruction value to the pilot pressure control valve 5.

In the present embodiment described above, the operation of the work device 30 is equivalently expressed using a motion state amount of a combined center of gravity of a plurality of members (the boom 31, the arm 32, and the bucket 33) which constitute the work device 30. That is, the construction machine 100 according to the present embodiment can handle an operation of the work device 30 in an equivalent system which is a system where the operation of the work device 30 is expressed by a motion state amount of a combined center of gravity G. In the construction machine 100, the operation of the work device 30 is controlled by using the equivalent system described above. Accordingly, it is unnecessary to compare the respective operations of the plurality of members 31, 32, 33 which constitute the work device 30 with the first target value individually. It is also unnecessary to evaluate whether or not the combination of the operations of the plurality of members 31, 32, 33 is appropriate. As a result, the work can be efficiently performed.

Specifically, in the construction machine 100, the instruction value generated by using the feedback control based on the first target value and the motion state amount is inputted to at least one of the plurality of pilot pressure control valves 5 which constitute the flow rate regulating part. With such a configuration, for example, even when the motion state amount of the combined center of gravity G deviates from the first target value due to an excessive manipulation by a manipulator, an operation of at least one of the plurality of pilot pressure control valves 5 is controlled such that the motion state amount follows the first target value. As a result, a change in motion state amount (for example, a change in speed) of the work device 30 caused by the excessive manipulation is suppressed and hence, a work operation such as excavation is stabilized. Accordingly, work efficiency can be enhanced.

In the present embodiment, the control device 18 may be mounted in the cab of the upper slewing body 20, for example. Further, the control device 18 may be mounted on an external apparatus which is communicably connected to the construction machine 100 via a network. The external apparatus is a server or a personal computer, for example. In this case, the construction machine 100 transmits information such as the motion state amount and the pressure signal to the external apparatus. The external apparatus receives these pieces of information. Then, the external apparatus transmits data for controlling driving of the work device 30 to the construction machine 100. The construction machine 100 receives the data transmitted from the external apparatus. The construction machine 100 controls an operation of the work device 30 based on the received data.

Further, the control device 18 includes a computer. By allowing the computer to execute a program, respective functions of the acquiring part 18A and the generating part 18B are executed. A computer has a processor which operates in accordance with a program as a main hardware configuration. A kind of processor is not limited as long as the functions can be realized by executing the program. The processor may be framed of one or a plurality of electronic circuits which includes or include a semiconductor integrated circuit (IC) or a large scale integration (LSI), for example. The plurality of electronic circuits may be integrated on one chip or may be mounted on a plurality of chips. The plurality of chips may be integrated in one device, or may be provided to a plurality of devices. The program is recorded in a non-volatile recording medium such as a ROM, an optical disc or a hard disk drive which is readable by the computer. The program may be stored in a recording medium in advance, or may be supplied to a recording medium via a wide area communication network including the Internet or the like.

Hereinafter, an excavation operation which is an example of the operation by the construction machine 100 according to the present embodiment is described. In the following specific example, a combined manipulation where an arm-pulling manipulation is applied to the manipulation lever 4A of the arm manipulation device 4 and a boom-raising manipulation is applied to the manipulation lever 4A of the boom manipulation device 4 (a combined manipulation of the arm pulling manipulation and the boom raising manipulation) is performed. Further, in the following specific example, a motion state amount of a combined center of gravity of the work device 30 is a speed of the combined center of gravity G (gravity center speed).

[Acquisition of Motion State Amount]

First, the acquiring part 18A of the control device 18 calculates a position (Xg, Yg) of the combined center of gravity G of the work device 30 using a position (x1, y1) of the center of gravity g1 of the boom 31, a position (x2, y2) of the center of gravity g2 of the arm 32, a position (x3, y3) of the center of gravity g3 of the bucket 33, and a following equation. Hereinafter, the combined center of gravity may be referred to as an equivalent center of gravity. The positions of the centers of gravity of the plurality of members 31, 32, and 33 can be directly measured by a positioning sensor such as a GPS sensor or a GNSS sensor. The position of the center of gravity of each of the plurality of members 31, 32, 33 can be also calculated based on angular information of the members measured by a sensor such as an angle sensor. The positions of the centers of gravity of the respective members and the position of the equivalent center of gravity G may be expressed in an xy coordinate system using a proximal end of the boom 31 as an origin in a two-dimensional vertical plane which is a motion plane of the work device 30 during performing a combined manipulation including an arm-pulling manipulation and a boom-raising manipulation, for example.

[Formula 1]

$$(X_9, Y_9) = \left(\frac{m_1x_1 + m_2x_2 + m_3x_3}{m_1 + m_2 + m_3}, \frac{m_1y_1 + m_2y_2 + m_3y_3}{m_1 + m_2 + m_3}\right) \quad (1)$$

In the equation (1), $m_1$, $m_2$, and $m_3$ are masses of the boom 31, the arm 32, and the bucket 33 respectively. Further, the mass $m_3$ of the bucket 33 includes a mass of soil and sand in the bucket 33.

When the combined manipulation including the arm-pulling manipulation and the boom-raising manipulation is performed, a pilot pressurized oil having a pilot pressure corresponding to a manipulation amount applied to the manipulation lever 4A of the arm manipulation device 4 is outputted from the remote control valve 4B of the arm manipulation device 4, and a pilot pressurized oil having a pilot pressure corresponding to a manipulation amount applied to the manipulation lever 4A of the boom manipulation device 4 is outputted from the remote control valve 4B of the boom manipulation device 4.

The arm pressure sensor 6 detects a pilot pressure of the pilot pressurized oil outputted from the remote control valve 4B of the arm manipulation device 4, and a pressure signal corresponding to the detected pilot pressure is inputted to the control device 18. In the same manner, the boom pressure sensor 6 detects a pilot pressure of the pilot pressurized oil outputted from the remote control valve 4B of the boom manipulation device 4, and a pressure signal corresponding to the detected pilot pressure is inputted to the control device 18.

A pilot pressure of the pilot pressurized oil outputted from the remote control valve 4B of the arm manipulation device 4 is reduced in the aim pilot pressure control valve 5 according to an opening area which corresponds to the instruction value, and the reduced pilot pressure is inputted to the pilot port corresponding to the arm-pulling manipulation out of the pair of pilot ports of the arm control valve. In the same manner, a pilot pressure of the pilot pressurized oil outputted from the remote control valve 4B of the boom manipulation device 4 is reduced in the boom pilot pressure control valve 5 according to an opening area which corresponds to the instruction value, and the reduced pilot pressure is inputted to the pilot port corresponding to the boom-raising manipulation out of the pair of pilot ports of the boom control valve.

The arm control valve opens and closes so as to change a flow rate of hydraulic oil supplied from the second hydraulic pump 2B to the arm cylinder 52 in accordance with the pilot pressure inputted to the pilot port. In the same manner, the boom control valve opens and closes so as to change a flow rate of hydraulic oil supplied from the first hydraulic pump 2A to the boom cylinder 51 in accordance with the pilot pressure inputted to the pilot port. With such operations, a arm-pulling operation of the arm 32 is performed in accordance with a flow rate of the hydraulic oil supplied to the arm cylinder 52, and a boom-raising operation of the boom 31 is performed in accordance with a flow rate of the hydraulic oil supplied to the boom cylinder 51.

The control device 18 may be configured to input a capacity instruction signal to the first regulator 2C and the second regulator 2D respectively such that a pump capacity of the first hydraulic pump 2A and a pump capacity of the second hydraulic pump 213 are adjusted in accordance with a manipulation amount applied to the manipulation lever 4A of the boom manipulation device 4 and a manipulation amount applied to the manipulation lever 4A of the arm manipulation device 4 respectively.

Next, the acquiring part 18A of the control device 18 calculates a speed Vg of the equivalent center of gravity G using following equations (2) to (4) based on a displacement amount per unit time of the position (Xg, Yg) of the equivalent center of gravity G when the arm pulling operation and the boom raising operation are performed.

[Formula 2]

$$V_x = \frac{dX_g(t)}{dt} \quad (2)$$

[Formula 3]

$$V_y = \frac{dY_g(t)}{dt} \quad (3)$$

[Formula 4]

$$V_g = \sqrt{V_x^2 + V_y^2} \quad (4)$$

A primary-order lag filter may be used in the calculation of the speed Vg of the equivalent center of gravity G used for controlling the work device 30. In this case, a stable value (speed Vg) is calculated by removing high frequency components. In case that the primary-order lag filter is added, the speed V of the combined center of gravity can be set to values expressed by following equations (5) to (7).

[Formula 5]

$$V(k) = a \times V_g(k-1) + b \times V_g(k) \tag{5}$$

[Formula 6]

$$a = \exp\left(-\frac{T_s}{1000/f}\right) \tag{6}$$

[Formula 7]

$$b = 1 - a \tag{7}$$

In the equations (5) to (7), k is the number of steps of data, Ts is a sampling time (unit: ms), and f is a low-pass frequency (unit: Hz).

[Generation and Inputting of Instruction Value]

The generating part 18B of the control device 18 generates an instruction value for controlling an operation of the flow rate regulating part such that the motion state amount acquired by the acquiring part 18A follows a predetermined first target value using a feedback control based on the first target value and the motion state amount, and inputs the instruction value to the flow rate regulating part.

Figure 3:
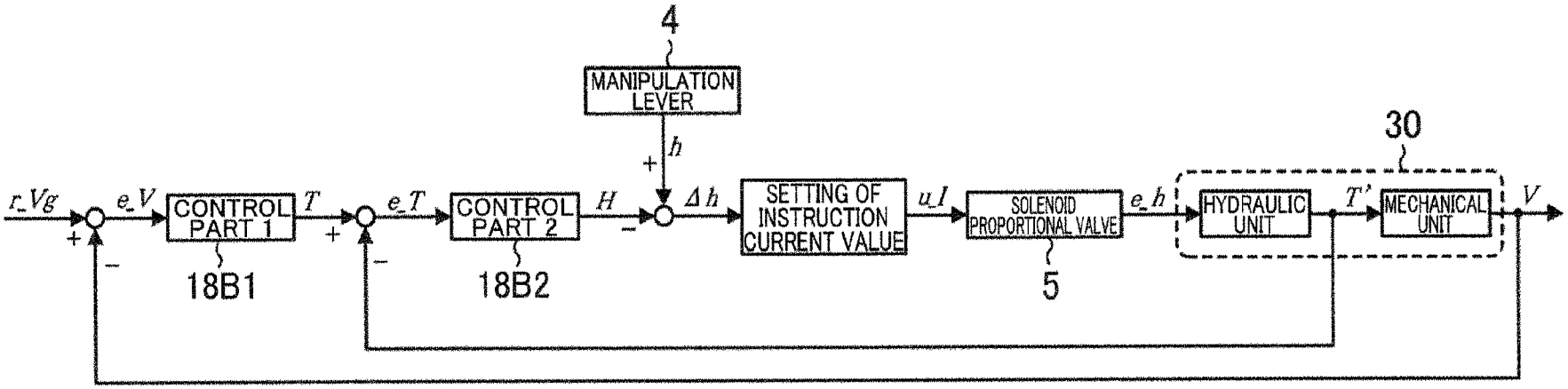
FIG. 3 is a view showing a control flow of a work device in the construction machine according to the embodiment.

Specifically, as shown in FIG. 3, the generating part 18B includes a first control part 18B1 and a second control part 18B2. The first control part 18B1 determines a second target value which is a target value of a driving force for driving the work device 30 using a feedback control based on a difference between the first target value and the motion state amount. The second control part 18B2 determines the instruction value (an instruction current value u_I described later) using a feedback control based on a difference between the second target value and an actual driving force which is a driving force for actually driving the work device 30.

Hereinafter, the generating part 18B is described, with reference to the control flowchart shown in FIG. 3, by taking a case where a speed V of the combined center of gravity G is controlled by the control device 18 as an example. In FIG. 3, the "hydraulic unit" includes the control valve 7 which is a constitutional component of the hydraulic circuit shown in FIG. 2, and the "mechanical unit" includes the plurality of members 31, 32, 33 which constitute the work device 30 shown in FIG. 1 and FIG. 2.

First, the first control part 18B1 of the generating part 18B in the control device 18 obtains a target drive torque T which is an example of the second target value by a PID control using a following equation (8), for example, based on a difference (deviation) e_V between a speed V of the combined center of gravity G obtained as described previously and a target speed r_Vg. The target drive torque T is a torque required for making an actual speed V of the combined center of gravity G follow the target speed r_Vg, and is a target value of a drive torque which the hydraulic actuator (the boom cylinder 51, and the arm cylinder 52) which drives the work device 30 generates.

The first control part 18B1 calculates the target drive torque T which is a target value of a drive torque of the boom cylinder 51, and calculates the target drive torque T which is a target value of a drive torque of the arm cylinder 52 respectively.

[Formula 8]

$$u_1(t) = k_{P1}e_1(t) + k_{I1}\int_0^t e_1(\tau)d\tau + k_{D1}\frac{de_1(t)}{dt} \tag{8}$$

In the equation (8), e1 is a speed deviation e_V (unit: mm/s) of the combined center of gravity, u1 is a target drive torque T of the actuator, kP1 is a proportional gain, kI1 is an integral gain, and kD1 is a differential gain. Here, kP1, kI1 and kD1 are parameters which are determined in accordance with work conditions.

The target speed r_Vg may be set based on past work data of a skilled manipulator, for example. Further, the target speed r_Vg may be a fixed value preset for each work content. Further, the target speed r_Vg may be a value specified by a map preset for each work content. In the map, when the work content is excavation work, a series of target speeds r_Vg from the start of the excavation work to the end of the excavation work are set in time series. The target speed r Vg in time series may be set based on the past work data of a skilled manipulator, for example. Alternatively, an ideal time-series target speed may be set as the target speed r_Vg by simulation or the like in consideration of work efficiency.

Next, the second control part 18B2 determines an instruction current value u_I which is an example of the instruction value in accordance with the following control flow using a feedback control based on a difference between the target drive torque T and an actual drive torque T' which is a drive torque for actually driving the work device 30. The instruction current value u_I has a magnitude of a current to be inputted to the pilot pressure control valve 5. The instruction current value u_1 is an instruction value for adjusting the pilot pressure outputted from the pilot pressure control valve 5 such that the actual drive torque T' follows the target drive torque T.

Specifically, as shown in FIG. 3, the second control part 18B2 of the generating part 18B in the control device 18 obtains a target pilot pressure H by a PID control using a following equation (9), for example, based on a difference (deviation) e_T between the actual drive torque T' (the actually generated drive torque) and the target drive torque T. The target pilot pressure H is a pilot pressure required for making the actual drive torque T' follow the target drive torque T, and is a target value of a pilot pressure supplied to the control valve 7.

[Formula 9]

$$u_2(t) = k_{p2}e_2(t) + k_{I2}\int_0^t e_2(\tau)d\tau + k_{D2}\frac{de_2(t)}{dt} \tag{9}$$

In the equation (9), e2 is a drive torque deviation e_T (unit: Nm) of the actuator, u2 is the target pilot pressure H (unit: MPa), kP2 is a proportional gain, kI2 is an integral gain, and kD2 is a differential gain. Here, kP2, kI2, and kD2 are parameters which are determined depending on work conditions.

Figure 4:
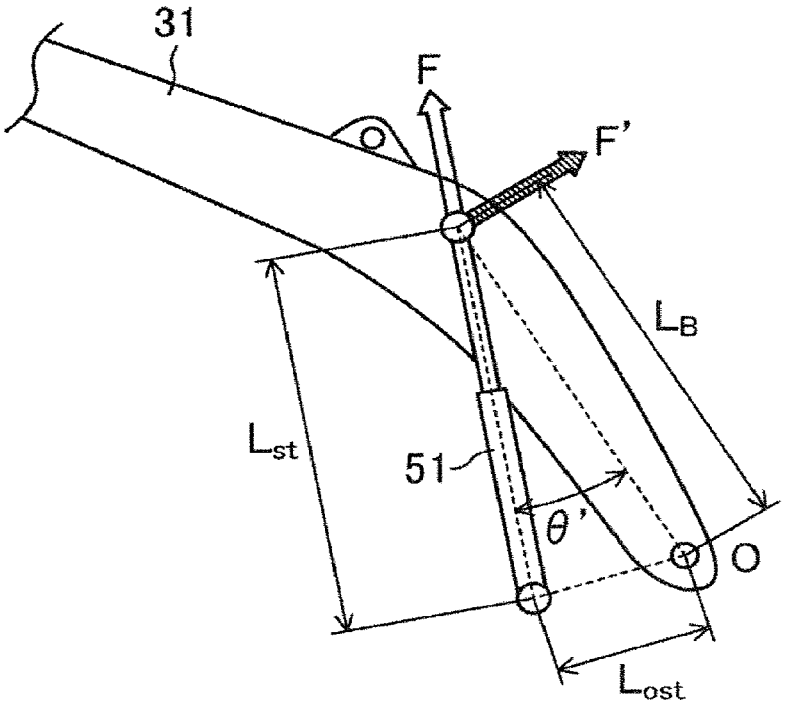
FIG. 4 is a view showing a method of obtaining an actual driving force for driving the work device.

FIG. 4 is a view showing a method of obtaining the actual drive torque T'. FIG. 4 shows an example of a method of obtaining the actual drive torque T' for driving the boom 31, for example. Hereinafter, the method of obtaining the actual drive torque T' is described with reference to FIG. 4. In FIG. 4, Lst indicates a cylinder stroke length, LB indicates a length from a proximal end of the boom to a cylinder mounting position. Lost indicates a length from the proximal end of the boom to a proximal end of the cylinder, and θ' indicates an angle made by the boom and the cylinder, F indicates a thrust of the boom cylinder, and F' is a force for generating a drive torque (a force acting perpendicular to a line which connects the cylinder mounting position and the proximal end of the boom at the cylinder mounting position). In FIG. 4, constitutional components identical with the corresponding constitutional components of the construction machine shown in FIG. 1 are given the same symbols. Further, LB and Lost are values determined based on the specification of construction machine, and Lst is a value measured by a sensor or the like.

First, the second control part 18B2 of the generating part 18B calculates a boom cylinder thrust F by a following equation (10), for example.

[Formula 10]

$$F=(P_{BH}\times A_{BH})-(P_{BR}\times A_{BR}) \tag{10}$$

In the equation (10), $P_{BH}$ is a head pressure of the boom cylinder 51, $P_{BR}$ is a rod pressure of the boom cylinder 51, $A_{BH}$ is a head pressure receiving area of the boom cylinder 51, and $A_{BR}$ is a rod pressure receiving area of the boom cylinder 51.

Further, an angle θ' made by the boom 31 and the boom cylinder 51 can be calculated by a following equation (11) using the cosine theorem.

[Formula 11]

$$\theta' = \arccos\left(\frac{L_{st}^2 + L_B^Z - L_{ost}^2}{2L_{st}\times L_B}\right) \tag{11}$$

Accordingly, the second control part 18B2 can calculate the actual drive torque T' by a following equation (12).

[Formula 12]

$$T = F'L_B = F\cos\left(\frac{\pi}{2} - \theta'\right)L_B \tag{12}$$

With reference to FIG. 3 again, the second control part 18B2 generates the indicated current value u_I in accordance with the following flow using the target pilot pressure H calculated based on the equation (9) as described above. First, the second control part 18B2 calculates a pilot pressure difference Δh which is a difference between a pressure h detected by the pressure sensor 6 and the target pilot pressure H. The pilot pressure difference Δh is a decompression amount Δh which needs to be decompressed in the pilot pressure control valve 5.

Figure 6:
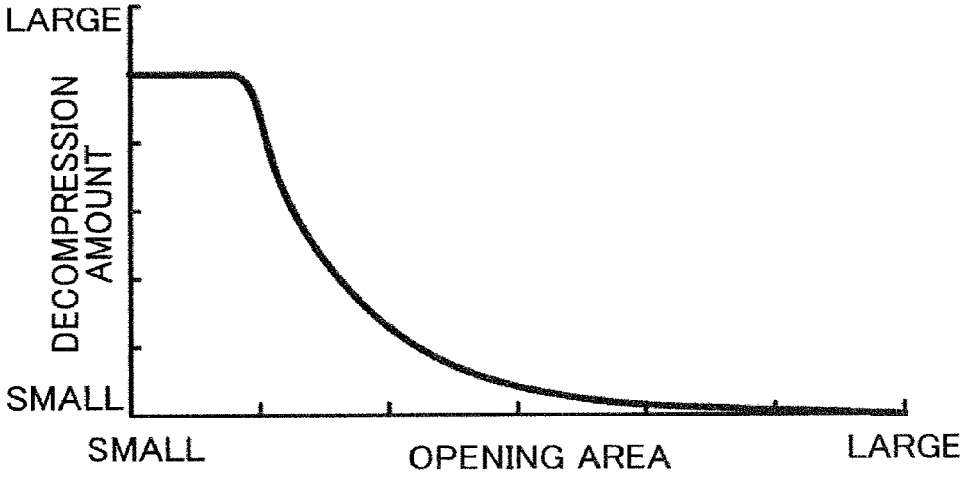
FIG. 6 is a view showing the relationship between an opening area of the solenoid valve and a decompression amount in the construction machine according to the embodiment.

FIG. 6 is a map showing the relationship between the decompression amount Δh and an opening area of the pilot pressure control valve 5. The map is stored in advance in the control device 18. The second control part 18B2 determines a target value of an opening area of the pilot pressure control valve 5 based on a calculated pilot pressure difference Δh (the decompression amount Δh) and the map shown in FIG. 6.

FIG. 5 is a map showing the relationship between the opening area of the pilot pressure control valve 5 and an instruction current value inputted from the second control part 18B2 to the pilot pressure control valve 5. The map is stored in advance in the control device 18. As described above, in the present embodiment, a solenoid inverse proportional valve is used as the pilot pressure control valve 5. The second control part 18B2 determines an instruction current value u_I (unit: mA) to be inputted to the pilot pressure control valve 5 based on the target value of the determined opening area and the map shown in FIG. 5.

In the present embodiment, the description is made by taking the combined manipulation including the arm pulling manipulation and the boom raising manipulation as an example. Accordingly, the second control part 18B2 determines an instruction current value u_I to be inputted to the arm pilot pressure control valve 5 and an instruction current value u_I to be inputted to the boom pilot pressure control valve 5 respectively in accordance with the above-mentioned flow.

Next, the second control part 18B2 of the generating part 18B inputs the instruction current value u_I generated by the above-mentioned flow to the solenoid of the corresponding pilot pressure control valve 5. With such an operation, the pilot pressure control valve 5 is set to an opening area corresponding to the instruction current value u_I. As a result, a pressure of the pilot pressurized oil (pilot pressure before decompression) outputted from the remote control valve 4B is decompressed to a pilot pressure e_h in the pilot pressure control valve 5. The decompressed pilot pressure e_h becomes the same value as the target pilot pressure H or a value close to the target pilot pressure H.

The pilot pressure e_h of the pilot pressurized oil outputted from the pilot pressure control valve 5 is inputted to the pilot port of the corresponding control valve in the control valve 7. The control valve opens or closes so as to change a flow rate of hydraulic oil supplied from the hydraulic pump to the corresponding cylinder in accordance with the pilot pressure e_h.

Specifically, in the present embodiment, the pilot pressure e_h of the pilot pressurized oil outputted from the arm pilot pressure control valve 5 is inputted to the pilot port of the arm control valve in the control valve 7, and the arm control valve opens or closes so as to change a flow rate of hydraulic oil supplied from the second hydraulic pump 2B to the arm cylinder 52 in accordance with the pilot pressure e_h. In the same manner, the pilot pressure c_h of the pilot pressurized oil outputted from the boom pilot pressure control valve 5 is inputted to the pilot port of the boom control valve in the control valve 7, and the boom control valve opens and closes so as to change a flow rate of the hydraulic oil supplied from the first hydraulic pump 2A to the boom cylinder 51 in accordance with the pilot pressure e_h. Due to such an operation, each of the cylinders generates an actual drive torque T' which is the same value as the target drive torque T or a value close to the target drive torque T. As a result, a speed Vg of the combined center of gravity G (equivalent center of gravity G) is adjusted to the same value as the target speed r_Vg or a value close to the target speed r_Vg.

The control device 18 feeds back an adjusted speed Vg of the combined center of gravity G to the first control part 18B1 of the control device 18, and feeds back adjusted actual drive torques T' which the respective cylinders (the boom cylinder 51, the arm cylinder 52) generate to the second control part 18B2 of the control device 18 and repeats the above-mentioned processing. With such an operation, the control device 18 can make the speed Vg of the combined center of gravity G follow the target speed r_Vg (see FIG. 3).

In this manner, because of the feedback control shown in FIG. 3, even when a manipulation skill of a manipulator is low, an operation of the flow rate regulating part is controlled so as to avoid the occurrence of a state where a speed of the member such as the boom 31 which constitutes the work device 30 becomes unstable attributed to a sudden manipulation. Accordingly, it is possible to realize the stabilization and the enhancement of efficiency of the work without relying on a manipulation skill of a manipulator.

The description of the embodiment described above is merely provided for an exemplifying purpose, and is not intended to limit the present invention, its application or its use. Various modifications are conceivable within the scope of the invention.

For example, in the above-mentioned embodiment, a solenoid valve (for example, an inverse proportional valve) is used as the pilot pressure control valve 5. However, as the pilot pressure control valve 5, other types of valves may be used in place the solenoid valve.

A PID control is used in the feedback control by the controller (control device 18). However, for example, an arithmetic expression, a map or the like may be used in place of the PID control.

Further, a speed is used as a motion state amount of the combined center of gravity G of the plurality of members constituting the work device 30 which is a target of the feedback control by the controller. However, at least one of a position, a speed, an acceleration and a jerk of the combined center of gravity G may be used.

Figure 8:
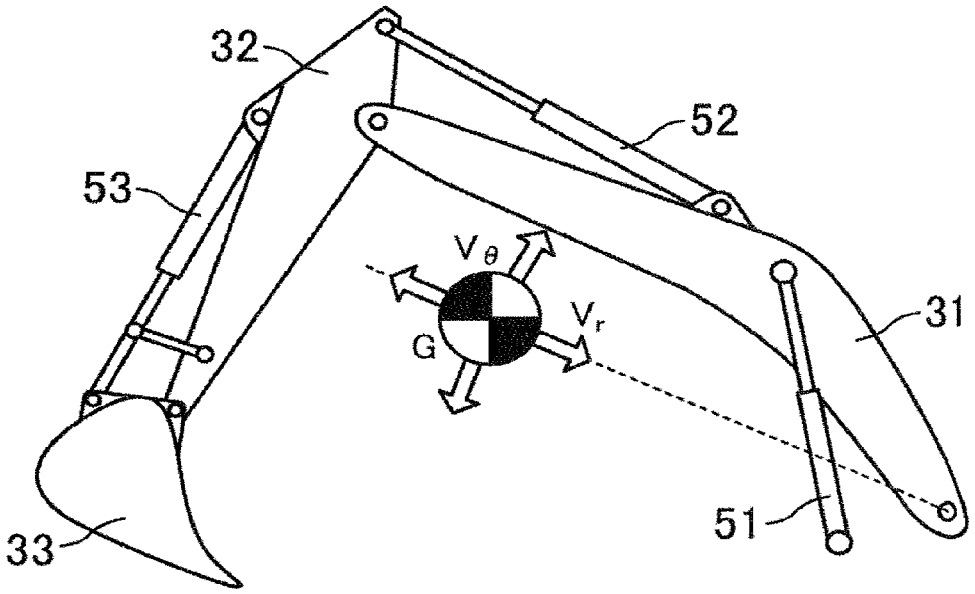
FIG. 8 is a view for describing a coordinate system showing a combined center of gravity of a work device according to a modification of the embodiment.

In addition, as the feedback control, a one-input and one-output system where a speed (velocity) of a two-dimensional coordinate system (xy coordinate system) is used as a target is exemplified. However, in order to control a speed of the combined center of gravity G more accurately, for example, as shown in FIG. 8, a motion of the combined center of gravity G of the work device 30 may be expressed in a polar coordinate system using the proximal end of the boom 31 as an origin. In FIG. 8, constitutional components identical with the corresponding constitutional components of the construction machine shown in FIG. 1 are given the same symbols. Specifically, a speed of the combined center of gravity G of the work device 30 may be divided into speeds in two directions, that is, a radial speed Vr and a rotational speed Vθ, and a drive torque of at least one hydraulic actuator out of the plurality of hydraulic actuators may be obtained such that the speeds Vr, Vθ respectively follow the target speeds. In this case, a PID control of a multi-input multi-output system can be realized where drive torques of the plurality of hydraulic actuators interact with the speeds Vr, Vθ. Further, the speeds Vr, Vθ can be calculated by following equations (13) to (16).

[Formula 13]

$$r = \sqrt{(x^2 + y^2)} \tag{13}$$

[Formula 14]

$$\theta = \tan^{-1}\left(\frac{y}{x}\right) \tag{14}$$

[Formula 15]

$$V_r = \frac{dr}{dt} \tag{15}$$

[Formula 16]

$$V_\theta = \frac{d\theta}{dt} \tag{16}$$

In the equations (13) to (16), (x, y) are coordinates of the combined center of gravity G of the work device 30 in the xy coordinate system, and (r, θ) are coordinates of the combined center of gravity G in the polar coordinate system.

Figure 9:
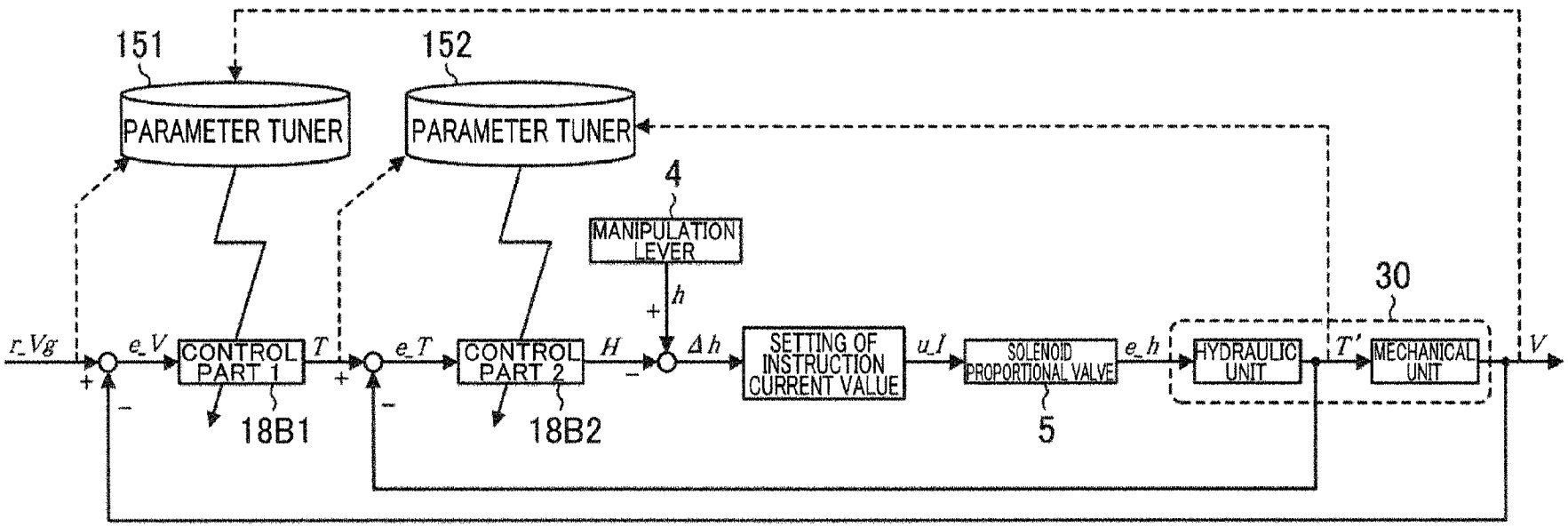
FIG. 9 is a view showing a control flow of a work device in a construction machine according to the modification of the embodiment.

The construction machine such as a hydraulic excavator adopts a non-linear system where a characteristic changes depending on a work content or a manipulation method. To enable a control which is more suitable for such a system, a modification shown in FIG. 9 may be adopted. In the modification, for example, as shown in FIG. 9, a control system may be configured to include a parameter tuner which changes control parameters (parameters in the equations (8) and (9)) in conformity with a work content or a manipulation method. The control system shown in FIG. 9 is obtained by providing a first parameter tuner 151 and a second parameter tuner 152 to the control system shown in FIG. 3. The first parameter tuner 151 changes the parameters in the equation (8) based on a target speed r_Vg and a combined-center-of-gravity speed V, and the second parameter tuner 152 changes the parameters in the equation (9) based on a target drive torque T and an actual drive torque T'.

In the above-mentioned embodiment, the hydraulic excavator provided with the bucket is exemplified as the distal end attachment of the work device 30 of the construction machine. However, the present invention is also applicable to a hydraulic excavator provided with a distal end attachment other than the bucket.

In the above-mentioned embodiment, the control is exemplified by focusing on a motion state amount of a combined center of gravity G of the work device 30 in an excavation operation (a combined manipulation including an arm pulling manipulation and a boom raising manipulation). However, it is needless to say that a manipulation to be controlled is not limited to "the combined manipulation including the arm pulling manipulation and the boom raising manipulation", and substantially the same control can be also performed in the combined manipulation for moving other attachment (bucket or the like). The manipulation to be controlled is not limited to the combined manipulation, and may be a single manipulation such as a boom single manipulation in which only the boom manipulation is performed, or an arm single manipulation in which only the arm manipulation is performed.

Each of the plurality of manipulation devices 4 is not limited to a manipulation device of a hydraulic pilot system, and may be an electric manipulation device. In the electric manipulation device, a manipulation amount of a manipulation lever 4A is converted into an electric signal, and the electric signal is inputted to the control device 18. The control device 18 inputs an instruction current corresponding to the manipulation amount to the pilot pressure control valve 5. The pilot pressure control valve 5 is interposed between the pilot pump 3 and the control valve 7, and guides a pilot pressure corresponding to the instruction current to the control valve 7.

In the above-mentioned embodiment, the flow rate regulating part is constituted of the plurality of pilot pressure control valves 5 and the control valve 7. However, the present invention is not limited to such a configuration. The flow rate regulating part according to the modification of the embodiment may be formed of at least one of the first regulator 2C and the second regulator 2D shown in FIG. 1, for example. Each regulator has a function of regulating a flow rate of hydraulic oil supplied from a corresponding hydraulic pump to a corresponding hydraulic actuator by regulating a pump capacity of the corresponding hydraulic pump. In this modification, the instruction value is inputted to the regulator. Hereinafter, the modification is briefly described.

Figure 7:
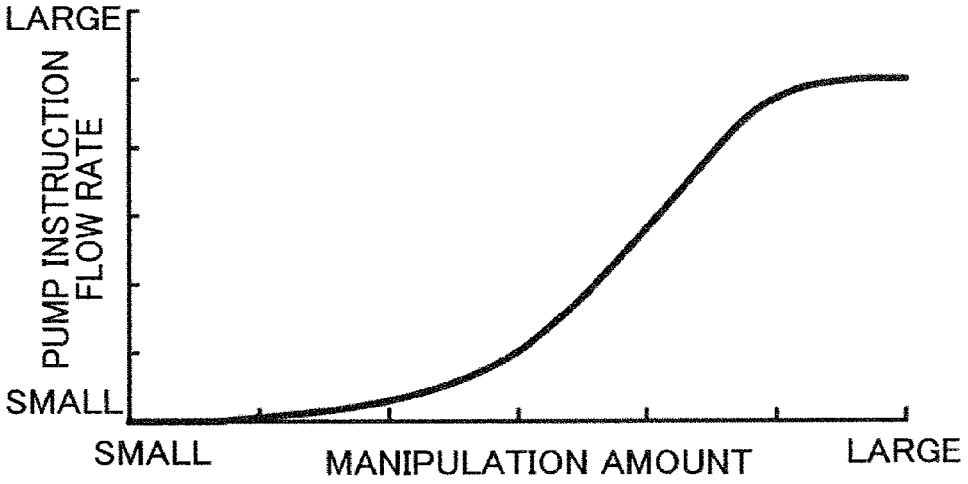
FIG. 7 is a view showing the relationship between a manipulation amount by a manipulator and a hydraulic pump discharge amount (pump instruction flow rate) in the construction machine according to the embodiment.

FIG. 7 is a map showing the relationship between a manipulation amount applied to the manipulation lever 4A and a pump capacity (pump instruction flow rate) of the hydraulic pump. The map shown in FIG. 7 shows the characteristic of the pump capacity when a feedback control based on the first target value and the motion state amount is not performed. That is, the map shown in FIG. 7 shows the characteristic of the pump capacity when a usual positive control is performed.

On the other hand, in the modification, the first control part 18B1 of the generating part 18B determines a second target value which is a target value of a driving force for driving the work device 30 using a feedback control based on a difference between the first target value and the motion state amount. The second control part 18B2 determines an instruction value inputted to at least one of the first regulator 2C and the second regulator 2D using a feedback control based on a difference between the second target value and an actual driving force which is a driving force for actually driving the work device 30. The regulator into which the instruction value is inputted regulates the pump capacity of the hydraulic pump to a capacity corresponding to the instruction value based on a map not shown in the drawing in which the relationship between the instruction value and the pump capacity is preset. With such a configuration, a flow rate of hydraulic oil supplied from the hydraulic pump to the corresponding hydraulic actuator is regulated.

The flow rate regulating part may be formed of the plurality of pilot pressure control valves 5, the control valve 7, and the regulator.

The technical features of the present embodiment are summarized as follows.

The construction machine according to the present embodiment includes: the lower travelling body; the upper slewing body which is attached to the lower travelling body with the structure which allows the upper slewing body to slew with respect to the lower travelling body; the work device which is attached to the upper slowing body with the structure which allows the work device to swing in a vertical direction with respect to the upper slewing body and includes the plurality of members; the hydraulic pump which discharges hydraulic oil; the hydraulic actuator which drives the work device by receiving the supply of the hydraulic oil discharged from the hydraulic pump; the flow rate regulating part which regulates the flow rate of the hydraulic oil supplied from the hydraulic pump to the hydraulic actuator; and the control device which controls driving of the work device, wherein the control device includes: the acquiring part which acquires the motion state amount of the combined center of gravity of the plurality of members; and the generating part which generates the instruction value for controlling an operation of the flow rate regulating part such that the motion state amount follows the predetermined first target value, the instruction value being used for executing a feedback control based on the first target value and the motion state amount, and inputs the instruction value to the flow rate regulating part.

In the construction machine according to the present embodiment, an operation of the work device is controlled such that the motion state amount of the combined center of gravity of the plurality of members which constitute the work device follows the first target value. Accordingly, unlike the conventional technique, it is possible to suppress occurrence of a change in speed of the hydraulic actuator unintended by the manipulator due to the pressurized oil regeneration performed on the hydraulic actuator and, further, by setting the first target value corresponding to various kinds of work, the control according to the embodiment can be applied not only to the finishing work but also to various kinds of work including excavation work and the like. Accordingly, even when an unskilled manipulator with low manipulation skill of a construction machine performs various kinds of work at a construction site, the work efficiency can be enhanced.

Further, in the construction machine according to the present embodiment, the operation of the work device is equivalently expressed by using the motion state amount of the combined center of gravity of the plurality of members which constitute the work device. That is, the construction machine can handle the operation of the work device in the equivalent system which is the system where the operation of the work device is expressed by the motion state amount of the combined center of gravity. In the construction machine, the operation of the work device is controlled by using the equivalent system described above. Accordingly, the operation can be efficiently performed without comparing the respective operations of the plurality of members which constitute the work device with the target value individually and without evaluating whether or not the combination of the operations of the plurality of members is appropriate.

Specifically, in the construction machine, the instruction value generated by using the feedback control based on the first target value and the motion state amount is inputted to the flow rate regulating part. With such a configuration, even when the motion state amount of the combined center of gravity deviates from the first target value due to an excessive manipulation by a manipulator, for example, the operation of the flow rate regulating part is controlled such that the motion state amount follows the first target value. As a result, a change in motion state amount (for example, a change in speed) of the work device due to the excessive manipulation is suppressed and hence, the work operation such as excavation is stabilized. Accordingly, work efficiency can be enhanced.

In the construction machine, the motion state amount may be at least one of the position, the speed, the acceleration and the jerk of the combined center of gravity.

In the construction machine, the generating part of the control device may include: the first control part which deter mines the second target value which is the target value of the driving force for driving the work device using the feedback control based on the difference between the first target value and the motion state amount; and the second control part which determines the instruction value using the feedback control based on a difference between the second target value and the actual driving force which is the driving force for actually driving the work device.

In this mode, the first control part generates the second target value for executing the feedback control based on the difference between the first target value and the motion state amount, and the second control part generates the instruction value for executing feedback control based on the difference between the second target value and the actual driving force. In this mode, the feedback control based on the difference between the first target value and the motion state amount is used and hence, the second target value which is a target value of the driving force appropriate for a situation of the work device at the time is determined, and the operation of the flow rate regulating part is controlled such that the actual driving force follows the second target value. That is, in this mode, the second target value for allowing the motion state amount to follow the first target value is determined, and the instruction value is generated such that the actual driving force follows the second target value. When the instruction value is inputted to the flow rate regulating part, the flow rate of the hydraulic oil supplied to the hydraulic actuator is regulated, and the actual driving force for driving the work device can approach the second target value. With such an operation, the motion state amount of the combined center of gravity can approach the first target value.

In the construction machine, the control device may be configured to be able to change the control parameter in the feedback control in accordance with the manipulation method or the work content.

In this mode, even when the movement of the work device is based on the nonlinear system where a characteristic changes depending on the manipulation method and the work content, by changing the control parameter to optimal value based on inputting and outputting or the like of the system, the motion which conforms with the work content and the manipulation method, that is, the stable work can be realized and hence, it is possible to realize the enhancement of the work efficiency.

In the construction machine, the flow rate regulating part may include: the pilot pressure control valve which is capable of outputting the pilot pressure corresponding to the instruction value by receiving inputting of the instruction value; and the control valve which regulates the flow rate of the hydraulic oil supplied from the hydraulic pump to the hydraulic actuator by receiving inputting of the pilot pressure outputted from the pilot pressure control valve.

In this mode, since the instruction value is inputted to the pilot pressure control value, the flow rate of the hydraulic oil supplied from the hydraulic pump to the hydraulic actuator can be regulated.

In the construction machine, the acquiring part may acquire the motion state amount by measuring or calculating the motion state amount.

As described above, in a construction machine such as a hydraulic excavator, for example, in work using the construction machine, a sudden change in motion state amount is suppressed using a motion state amount (speed, for example) of a combined center of gravity of a plurality of members which constitute a work device as an index and hence, it is possible to stabilize the work. With such a configuration, the unintended increase of the speed of the work device can be suppressed and hence, the positional accuracy of the work device can be enhanced. Further, since the flow rate of the hydraulic oil supplied to the hydraulic actuator is regulated such that the motion state amount of the combined center of gravity of the work device is stably maintained, the work device can continuously move in a stable manner during work such as excavation. Accordingly, an amount of work can be secured and hence, it is possible to enhance work efficiency.

The invention claimed is:

1. A construction machine comprising:

a lower travelling body;

an upper slewing body which is attached to the lower travelling body with a structure which allows the upper slewing body to slew with respect to the lower travelling body;

a work device which is attached to the upper slewing body with a structure which allows the work device to swing in a vertical direction with respect to the upper slewing body and includes a plurality of members;

a hydraulic pump which discharges hydraulic oil;

a hydraulic actuator which drives the work device by receiving a supply of the hydraulic oil discharged from the hydraulic pump;

a flow rate regulating part which regulates a flow rate of the hydraulic oil supplied from the hydraulic pump to the hydraulic actuator; and a control device which controls driving of the work device, wherein the control device includes:

an acquiring part which acquires a motion state amount of a combined center of gravity of the plurality of members; and a generating part which generates an instruction value for controlling an operation of the flow rate regulating part such that the motion state amount follows a predetermined first target value, the instruction value being used for executing a feedback control based on the first target value and the motion state amount, and inputs the instruction value to the flow rate regulating part, and wherein the generating part of the control device includes:

a first control part which determines a second target value which is a target value of a driving force for driving the work device using a feedback control based on a difference between the first target value and the motion state amount and a second control part which determines the instruction value using a feedback control based on a difference between the second target value and an actual driving force which is a driving force for actually driving the work device.

2. The construction machine according to claim 1, wherein the motion state amount is at least one of a position, a speed, an acceleration, and a jerk of the combined center of gravity.

3. The construction machine according to claim 1, wherein the control device is configured to be able to change a control parameter in the feedback control in accordance with a manipulation method or a work content.

4. The construction machine according to claim 1, wherein the flow rate regulating part includes:

a pilot pressure control valve which is capable of outputting a pilot pressure corresponding to the instruction value by receiving inputting of the instruction value; and a control valve which regulates the flow rate of hydraulic oil supplied from the hydraulic pump to the hydraulic actuator by receiving inputting of the pilot pressure outputted from the pilot pressure control valve.

5. The construction machine according to claim 1, wherein the acquiring part acquires the motion state amount by measuring or calculating the motion state amount.

* * * * *